United States Patent [19]

Murayama et al.

[11] Patent Number: 5,008,945

[45] Date of Patent: Apr. 16, 1991

[54] WATER-PROOF SPEAKER UNIT

[75] Inventors: Fumio Murayama; Tomiaki Ando, both of Yamagata, Japan

[73] Assignee: Pioneer Electronic Corp., Tokyo, Japan

[21] Appl. No.: 280,413

[22] Filed: Dec. 6, 1988

[30] Foreign Application Priority Data

May 23, 1988 [JP] Japan ..... 63-127388
May 24, 1988 [JP] Japan ..... 63-127662

[51] Int. Cl.[5] ..... H04R 25/00
[52] U.S. Cl. ..... 381/194; 381/202
[58] Field of Search ..... 381/158, 189, 192, 194, 381/197, 202, 204, 193

[56] References Cited

U.S. PATENT DOCUMENTS 1,907,687 5/1933 Van Lis ..... 381/197
2,221,068 11/1940 Alons ..... 381/197
3,073,916 1/1963 Williams et al. ..... 381/189
4,190,746 2/1980 Harwood et al. ..... 381/194
4,465,905 8/1984 Nation ..... 381/194
4,547,632 10/1985 Bryson ..... 381/189

FOREIGN PATENT DOCUMENTS 0147099 11/1980 Japan ..... 381/194
0207795 12/1983 Japan ..... 381/158
0005696 11/1986 Japan ..... 381/194
18899 1/1987 Japan ..... 381/194
0215294 9/1988 Japan ..... 381/199

*Primary Examiner*—Forester W. Isen
*Assistant Examiner*—M. N. McGeary, III
*Attorney, Agent, or Firm*—Sughrue,Mion,Zinn,Macpeak & Seas

[57] ABSTRACT

In a speaker unit having a voice coil bobbin, a diaphragm and a damper, the voice coil bobbin is integrally molded with at least one of the damper and diaphragm. The voice coil may be molded into the voice coil bobbin, and the brocade lead wires from the voice coil may be molded into the damper.

3 Claims, 2 Drawing Sheets

WATER-PROOF SPEAKER UNIT

BACKGROUND OF THE INVENTION

The present invention relates to a speaker unit, and more particularly to a speaker unit having improved water-proof properties.

In a conventional water-proof speaker unit. the water-proof/water-resistant material is selected for any vibration members which may be exposed, such as a vibrating edge. a diaphragm. etc., or such members are coated with a water-proof material. In addition, the rear side of the diaphragm cabinet is made water-proof and/or water resistant, with the goal being to obtain a water-proof speaker unit.

In a conventional water-proof speaker unit of the type described above, the selection of a water-proof material for the vibrating members per se will result in a high cost, and the coating of the members with a water-proof material will result in an increase in the number of manufacturing steps while also increasing the material's cost per se. In either case the resulting product is expensive.

In addition, even aside from cost. it is very difficult to provide a water-proof property to a brocade lead wire for supplying a drive current to the voice coil.

It is, therefore, an object of the present invention to provide an inexpensive water-proof speaker unit capable of providing not only the speaker unit structure but also the brocade lead wire with acceptable water-proof properties.

SUMMARY OF THE INVENTION

The inexpensive water-proof speaker unit according to the present invention is realized by using an inexpensive plastic material to integrally mold certain parts. In one embodiment, the damper and voice coil bobbin may be integrally molded with plastics, and in a second embodiment the diaphragm and voice coil bobbin may be integrally molded with plastics. In either case, the voice coil may be either wound around the outside of the voice coil bobbin or may be pre-wound and insert-molded into the voice coil bobbin. To provide water-proofing for the brocade lead wire the wire may be molded into the damper.

BRIEF DESCRIPTION OF THE DRAWINGS

The invention will be more clearly understood from the following description in conjunction with the accompanying drawings, wherein.

DETAILED DESCRIPTION OF THE PREFERRED EMBODIMENTS

Figure 1:
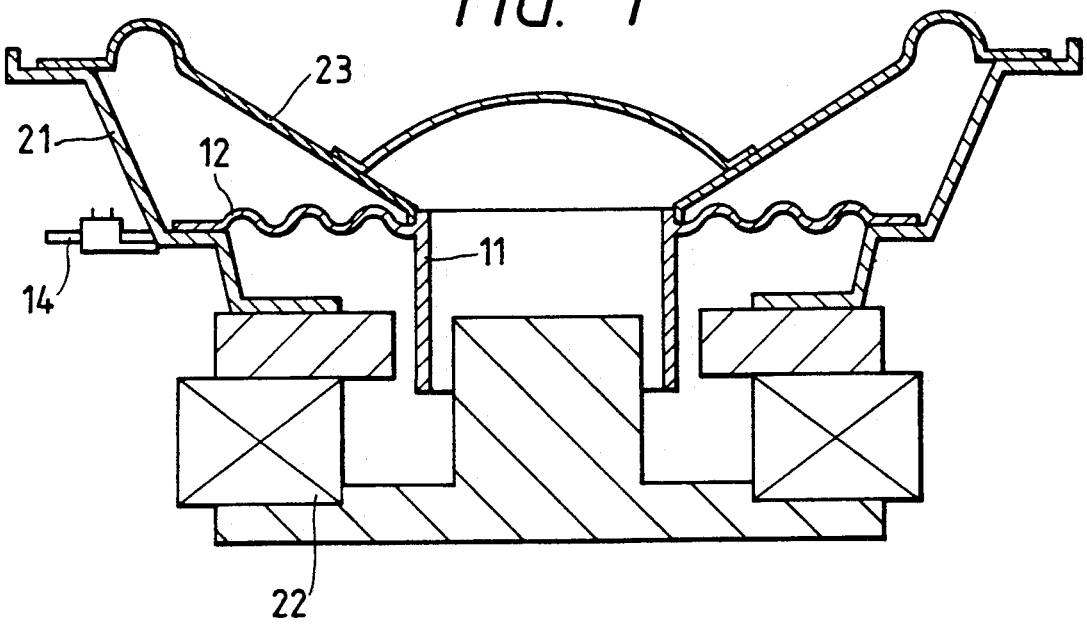
FIG. 1 is an illustration of a speaker unit according to a first embodiment of the present invention.
Figure 2:
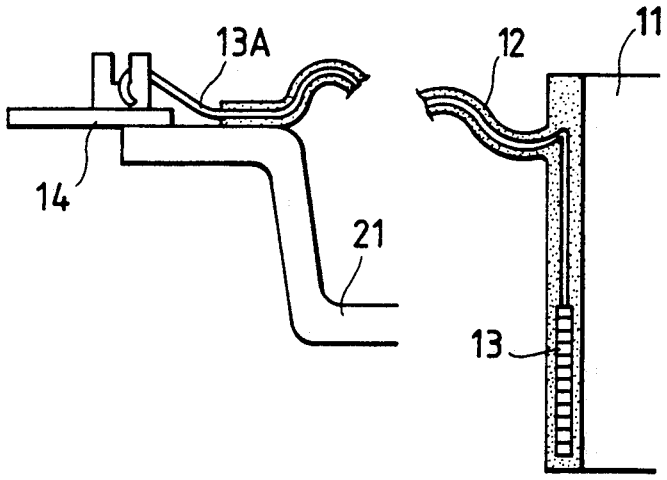
FIG. 2 is an enlarged sectional view showing a voice coil arrangement for the embodiment of FIG. 1.
Figure 3:
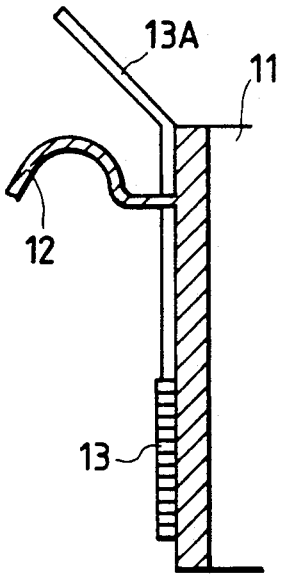
FIG. 3 is an enlarged sectional view of an alternative voice coil arrangement for the embodiment of FIG. 1.

Referring now to FIGS. 1–3, reference 11 designates a voice coil bobbin. A flange-like corrugated damper 12 is integrally plastic molded with the voice coil bobbin 11 so that the damper 12 extends radially outwardly from the circumference of the voice coil bobbin 11 at one axial end thereof.

As shown more clearly in the enlarged diagram of FIG. 2, a voice coil 13 which has been wound in advance is insert-molded within the voice coil bobbin 11. The two ends of the voice coil 13, having the function of brocade lead wires and being designated by reference character 13A in FIG. 2, are insert molded within the corrugated damper 12 which is integral with the voice coil bobbin 11. The conductors then extend outwardly from the outer radial edge of the damper to be connected to terminals 14 provided on the speaker frame 21.

In FIGS. 1 and 2, reference 22 designates a magnetic circuit attached to the speaker frame 21. The voice coil 13 is molded into the voice coil bobbin 11 at a position such that it will be located in an air gap of the magnetic circuit 22. The inner and outer circumferential edges of a cone diaphragm 23 are fixedly attached to one end portion of the voice coil bobbin 11 and to the speaker frame 21. respectively.

In an alternate arrangement of the second embodiment shown in FIG. 3, the voice coil bobbin 11 and damper 12 are again integrally plastic molded. However, the voice coil 13 is not molded within the voice coil bobbin 11 but is instead wound around the outside of the voice coil bobbin 11. In this case, the conductors 13A may be led along the inner surface of the cone diaphragm 23 to be connected to the terminals 14. While this may not provide for water-proofing of the brocade lead wires as effectively as the arrangement of FIG. 2 it would provide a measure of water-proofing at a substantially reduced cost due to the integral plastic molding of the voice coil bobbin and damper.

Figure 4:
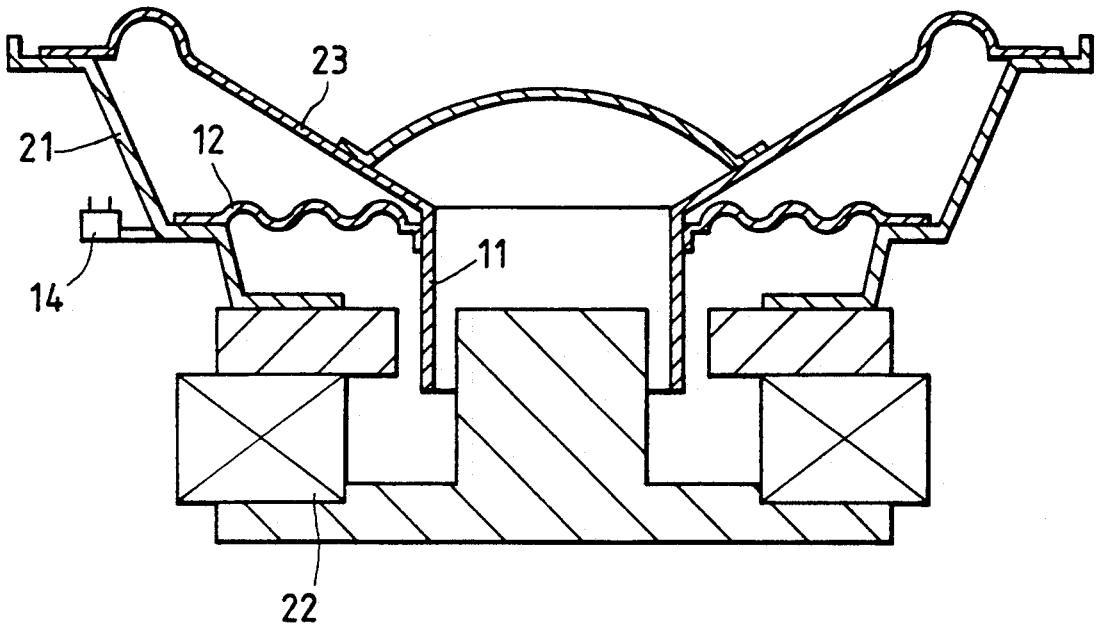
FIG. 4 is a sectional view showing a speaker unit according to a second embodiment of the present invention.
Figure 5:
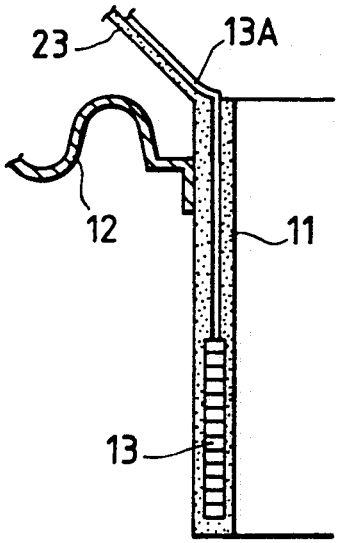
FIG. 5 is an enlarged sectional view showing a voice coil arrangement for the embodiment of FIG. 4.
Figure 6:
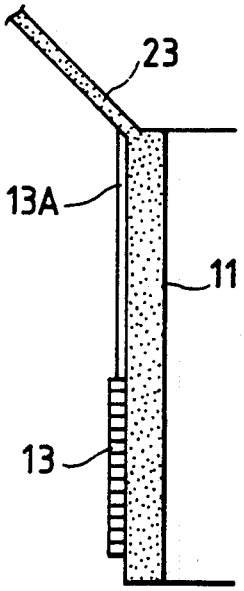
FIG. 6 is an enlarged sectional view of an alternative voice coil arrangement for the embodiment of FIG. 4.

The second embodiment of the invention is illustrated in FIGS. 4–6, wherein like components are designated by like reference numerals. The only difference between FIGS. 1 and 4 is in the cross-hatching, with FIG. 4 showing the voice coil bobbin 11 and cone diaphragm 23 as being integrally plastic molded. With reference to FIG. 5, it is seen that the voice coil 13 may be wound in advance and insert-molded into the voice coil bobbin 11, with the brocade lead wires 13A exiting one axial end of the voice coil bobbin and being led along a surface of the cone diaphragm 23 for connection to terminals 14 provided on the speaker frame 21. As in the embodiment of FIGS. 1 and 2, the voice coil 13 will be molded into the voice coil bobbin 11 at a position such that it will be located within an air gap of the magnetic circuit 22. As opposed to the embodiment of FIGS. 1 and 2 wherein the voice coil bobbin and damper are integrally molded, the inner and outer circumferential edges of the damper 12 in the embodiments of FIGS. 4 and 5 are fixedly attached to one end portion of the voice coil bobbin 11 and to the speaker frame 21, respectively.

FIG. 6 illustrates an alternative arrangement for the voice coil 13 in the second embodiment of the invention, in which the voice coil 13 may instead be wound on the outside of the voice coil bobbin 11 with the brocade lead wires being led along the inner surface of the cone diaphragm 23.

As will be apparent from the above description, the speaker unit according to the present invention forms certain parts of integrally molded plastic, the voice coil bobbin 11 and damper 12 in the first embodiment and the voice coil bobbin 11 and cone diaphragm 23 in the second embodiment. Accordingly, it is possible to obtain a speaker unit having superior water-proof and water-resistant properties at a low cost. In addition, embedding the brocade lead wires into the damper 12 will provide an additional measure of water-proof protection for these wires.

It will be appreciated that various changes and modifications can be to the embodiments described above without departing from the spirit and scope of the invention as defined in the appended claims.

What is claimed is:

1. A speaker unit, comprising:

a voice coil bobbin for carrying a voice coil; and a damper extending radially outwardly from the periphery of said voice coil bobbin, said voice coil bobbin and dampler being integrally molded of plastic, wherein said voice coil is molded into said voice coil bobbin, and further comprising at least one lead wire extending from said voice coil through said voice coil bobbin, said at least one lead wire being molded into said damper.

2. A speaker unit, comprising:

a voice coil bobbin for carrying a voice coil; and a diaphragm extending radially outwardly from the periphery of said voice coil bobbin, said voice coil bobbin and diaphragm being integrally molded of plastic, wherein said voice coil is molded into said voice coil bobbin, and further comprising at least one lead wire exiting one axial end of said voice coil bobbin and extending along a surface of said diaphragm for connection to a terminal.

3. A speaker unit comprising a voice coil bobbin for carrying a voice coil and diaphragm and damper members extending radially outwardly from the periphery of said voice coil bobbin, said speaker unit characterized in that said voice coil bobbin is internally molded with at least one of said diaphragm and damper members, wherein said voice coil is wound around the outside of said voice coil bobbin, and further comprising at least one lead wire extending from said voice coil and being led along an inner surface of said diaphragm.

* * * * *